US006318597B1

(12) United States Patent
Josephsen et al.

(10) Patent No.: US 6,318,597 B1
(45) Date of Patent: Nov. 20, 2001

(54) FLEXIBLE CONTAINER, A CARTRIDGE WITH A POWDERED FILLING, AND A METHOD OF MANUFACTURING A CARTRIDGE

(75) Inventors: Birger Josephsen, Solrod Strand; Kaj Nielsen, Tranbjerg, both of (DK)

(73) Assignee: Deltagraph A/S, Ringsted (DK)

( * ) Notice: Subject to any disclaimer, the term of this patent is extended or adjusted under 35 U.S.C. 154(b) by 0 days.

(21) Appl. No.: 09/448,085

(22) Filed: Nov. 23, 1999

Related U.S. Application Data

(63) Continuation-in-part of application No. PCT/DK98/00207, filed on May 22, 1998, now abandoned.

(30) Foreign Application Priority Data

May 23, 1997 (DK) ..... 0590/97

(51) Int. Cl.[7] ..... B67D 5/00
(52) U.S. Cl. ..... 222/83.5; 222/92
(58) Field of Search ..... 222/81, 83, 83.5, 222/92

(56) References Cited

U.S. PATENT DOCUMENTS

| | | | |
|---|---|---|---|
| 1,922,171 | 8/1933 | McMahon | 229/1.5 |
| 2,073,941 | 3/1937 | Lowen | 222/92 |
| 4,778,052 | 10/1988 | Mora | 222/92 |
| 4,884,703 | 12/1989 | O'Meara | 222/83 |
| 5,016,757 | 5/1991 | Chatourel | 222/83.5 |
| 5,447,699 | 9/1995 | Papciak et al. . | |

FOREIGN PATENT DOCUMENTS

| | | |
|---|---|---|
| 4336377 | 4/1995 | (DE) . |
| WO98/02360 | 1/1998 | (WO) . |

*Primary Examiner*—Joseph A. Kaufman
(74) *Attorney, Agent, or Firm*—Thomas R. Vigil

(57) ABSTRACT

A container (2) for bulk matter comprises a rigid mouthpiece (5), a pouch (4) in sealing connection with the mouthpiece, and a septum (6), which seals off the mouthpiece. The mouthpiece defines a lumen (7) matched to the pouch in order that the septum may be pierced to free an opening, by which any matter held by the container will be permitted to leave said pouch by flowing through the opening, substantially without meeting any restrictions. The invention also provides a cartridge with a powdered filling, and a method of manufacturing a cartridge.

15 Claims, 2 Drawing Sheets

FLEXIBLE CONTAINER, A CARTRIDGE WITH A POWDERED FILLING, AND A METHOD OF MANUFACTURING A CARTRIDGE

CROSS-REFERENCE TO RELATED APPLICATIONS

This is a continuation-in-part of International Application PCT/DK98/00207 with an international filing date of May 22, 1998, now abandoned. This application is based on application No. 0590/97 filed in Denmark on May 23, 1997, the contents of which are incorporated hereinto by reference.

BACKGROUND OF THE INVENTION

1. Field of the invention

The present invention relates to a container for bulk matter, to a use of a container, to a cartridge with a powdered filling, and to a method of manufacturing a cartridge with a powdered filling.

The invention is particularly relevant in the field of packaging and handling of powdered chemicals which need a sealed enclosure in order to prevent degrading interaction with ambient air.

The invention still more particularly relates to the field of handling of photographic chemicals.

2. Description of the Prior Art

U.S. Pat. No. 5,938,034 provides a sealed pouch for a powdered filling wherein the pouch, subsequent to the filling in of the powder, is evacuated and then sealed with the effect that the powder is immobilized. This publication also suggests to adapt the pouch with an extra length, which length subsequent to sealing and evacuation provides a collapsed neck section, providing a means for the user by which he may manipulate and guide pouring of the powder, once the neck has been cut open.

With a packaging of this kind, the evacuation has the effect that the powder is totally immobilized and that the package may be handled and piled like a brick. Once the seal has been cut open and air admitted into the pouch, the powder is relieved, and the package no longer maintains its shape.

One container available on the market for photographic chemicals comprises a plastic bottle with a reduced neck sealed by a sealing means, said package being adapted for automatic dispensing in a dispensing apparatus.

A dispensing apparatus available on the market comprises a fixture wherein the bottle is entered, flipped to present the neck downwards and retained, while a movable knife strikes from below to pierce the membrane and tear it loose along the greater part of the periphery in order that the center area of the membrane forms a flap secured along part of the edge. In case of photographic powdered chemicals, there may however be a tendency for the powder to form bridges inside a bottle with a reduced neck section, thus holding back the powder and making it difficult to empty the bottle completely. Besides, a bottle of this kind does not lend itself easily to collapsing following discharge of the filling. Therefore, the empty bottle occupies a substantial volume which adds to the cost of removing the scrap. A reduced neck bottle is furthermore difficult to clean on the inside, and in case the bottle has been utilized for chemicals, some regulations may require added precautions in handling the scrap in view of the chemical residues.

U.S. Pat. No. 5,314,069 provides a package of solid particulate photographic materials, comprising a sealed, evacuated envelope that defines a single chamber and at least three immobilized layers of solid particulate photographic materials contained in the envelope. At least two of the materials are mutually reactive and at least one of the materials is inert relative to the two which are mutually reactive, the layers of the at least two mutually reactive materials being separated by at least one intervening layer of the inert material.

SUMMARY OF THE INVENTION

The invention, in a first aspect, provides a container for bulk matter, comprising a substantially rigid mouthpiece, a pouch of flexible material in sealing connection with said mouthpiece, and a seal means adapted for sealing off said mouthpiece, said mouthpiece defining a lumen matched to said pouch in order that said seal means may be pierced to free an opening communicated with said pouch, and said mouthpiece defining a substantially circular spout with an exterior guiding surface, in order that said spout may be registered with and introduced into a suitable socket so as to be retained therein in a non-rotatable fashion.

This container is well suited for handling in automatic dispensing equipment, and it provides optimum conditions for discharging the contents and minimizes any risk of bridging inside the filling. The full size lumen in the mouthpiece provides convenient access for cleaning the pouch inside. The mouthpiece also provides a base by which the container may stand during discharge without any danger of forming folds or wrinkles which might otherwise intercept the unhindered discharge of the contents. Once the discharge has been completed, the flexible pouch may be collapsed to a minimum volume.

According to a preferred embodiment the pouch comprises a section of a hose or a tube which is sealed off in the end opposite the mouthpiece by a transverse weld. This provides a possibility for manually opening the cartridge by cutting the outermost portion of the end opposite the mouthpiece, and thus provides a dual use cartridge, equally well suited for emptying in automatic dispensing apparatuses as well as for manual dispensing.

According to a preferred embodiment the mouthpiece provides a substantially circular spout with an exterior guiding surface adapted for axially mating with a suitable socket and for being retained therein in a non-rotatable fashion. In this context, the term non-rotatable signifies that the spout is retained with sufficient grip to allow cutting open the seal means by piercing the seal means by a knife and rotating the socket to cut a slit in the seal means, without causing the spout to disengage the socket. This does not exclude that the grip may be overcome e.g. by rotation in an opposed direction or by overcoming a spring-loaded lock means for the purpose of removing the spout from the socket.

The seal means preferably comprises a seal membrane, structurally supported by the mouthpiece, in order not to deflect under the action by the knife.

This facilitates the process of opening the container in that a knife may be pierced through a part of the membrane and e.g. moved to form a slit adjacent a peripheral edge of the mouthpiece in order that the mouthpiece will support the seal membrane firmly during the cutting operation.

In other preferred embodiments the seal means comprises a peripheral surface. With this embodiment a cut may be performed by entering a knife in a radial direction of the mouthpiece and by rotating the mouthpiece relative to the knife. In this embodiment the bottom part of the cartridge may comprise a more sturdy quality of septum, as this part is not intended to be cut. This has the advantage that the bottom surface is well adapted for standing the container and minimizes the risk that normal wear of this surface might cause leakages in the container. The seal means may comprise a part with a reduced wall thickness, structurally supported by adjacent parts of the peripheral surface and by an adjacent container bottom wall. The section with reduced wall thickness facilitates the cutting open of the seal means.

The invention in a second aspect provides a use of a container for the packaging of a powdered chemical ingredient of a kind adapted for the preparation of a photographic bath. The container is well adapted for this use, since full discharge of the contents and cleaning of the inside is easily accomplished, whether by automatic means or by manual operation.

The invention, in a second aspect, provides a cartridge with a powdered filling, comprising a container with a substantially rigid mouthpiece, a pouch of flexible material in sealing connection with said mouthpiece, and a seal means adapted for sealing off said mouthpiece, said mouthpiece defining a lumen matched to said pouch in order that said seal means may be pierced to free an opening communicated with said pouch, and said mouthpiece defining a substantially circular spout with an exterior guiding surface, said container holding a filling of solid particulate materials comprising at least three layers, a first one and a second one of said layers comprising respective mutually reactive materials and a third one of said layers comprising a material, which is inert relative to the materials of said first and said second layer, said container being evacuated of air so as to immobilize said particulate materials and sealed.

This cartridge is well adapted for manipulating in automatic dispensing devices, and particularly adapted for dispensing powdered materials which may otherwise be difficult to handle due to imminent tendency to agglomeration, etc. A dispensing apparatus adapted for using the cartridge according to the invention is the subject of a co-pending International Patent Application No. PCT/DK98/00206, filed in the name of the same applicant on May 22, 1998.

The invention, in a third aspect, provides a method of manufacturing a cartridge holding a powdered material, comprising the steps of selecting a section of a hose of a flexible material, selecting a substantially rigid mouthpiece, which defines a lumen of a circumference substantially equivalent to that of the hose, and which is provided with externally accessible gripping surfaces by which said mouthpiece may be engaged, selecting a member comprising a seal means, in sealing connection with said mouthpiece in order to seal off said lumen, joining one end of said hose section in sealing connection with said mouthpiece in order that said hose section is communicated with said mouthpiece at the respective end, leaving an opposite end of the hose section open, filling in a predetermined quantity of powdered material through the open end of the hose, evacuating the hose of air, and sealing the end of the hose section opposite said mouthpiece.

This provides an expedient method for the manufacturing of a cartridge, exhibiting the advantages enumerated above in the context of the container.

BRIEF DESCRIPTION OF THE DRAWINGS

Further features, characteristics, and advantages of the invention will become apparent from the following description of preferred embodiments given with reference to the drawings wherein.

DESCRIPTION OF THE PREFERRED EMBODIMENTS

All figures are schematic and not necessarily to scale and illustrate only those items which are essential to enable those skilled in the art to understand the invention, while other items which are considered to be known in the art have been deleted for the sake of simplicity. In all figures the same references have been used about identical or similar items.

Figure 1:
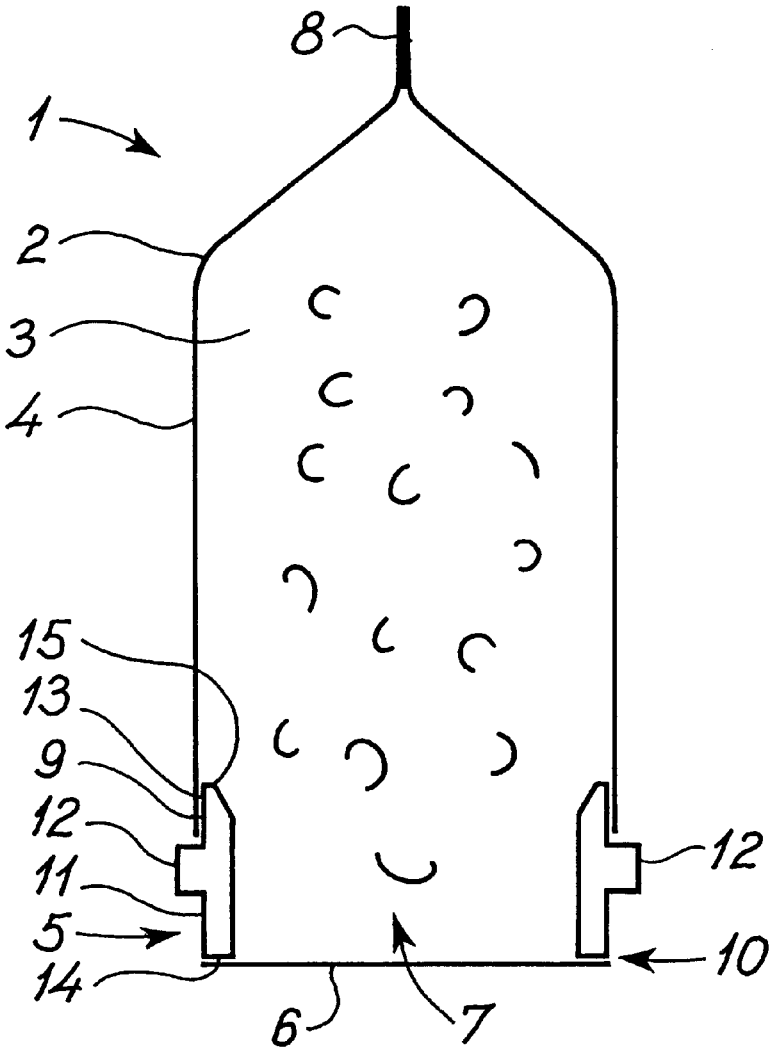
FIG. 1 illustrates a vertical axial section in a cartridge according to a first embodiment of the invention.
Figure 2:
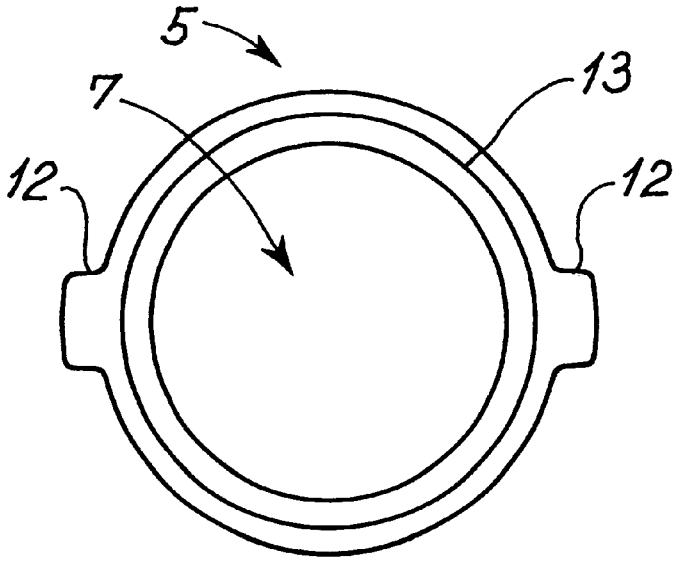
FIG. 2 illustrates a plan view of a component which forms part of the container according to the first embodiment.

Reference is first made to FIGS. 1 and 2 for a description of a container according to a first embodiment of the invention.

The container 2 illustrated in FIG. 1 basically comprises a pouch 4, mouthpiece 5 and a seal means, in this embodiment provided by a septum 6. This container 2 when filled with a filling 3 and properly sealed, provides a cartridge 1. The pouch 4 basically is formed from a section of a hose or a tube of flexible material. In the upper end as shown in FIG. 1, this tube section is closed and sealed by a linear transverse weld 8. In the lower end as shown in FIG. 1, this tube section is joined to the mouthpiece 5 by a tubular weld 9.

The tube, i.e. the pouch, may comprise a laminate material which is gas impervious and adapted to provide suitable barrier capacity in view of the matter to be contained by the cartridge. In case of photographic chemicals, it is presently preferred to use a polyethylene foil laminated with a polyamide foil to an overall thickness of 0.18 mm. In this foil polyethylene provides suitable barrier capabilities, while the polyamide provides structural qualities. The combined laminate is well adapted for welding, as it is possible to melt the polyethylene while the polyamide provides structural support. The suggestion of other materials for the tube will be within the capabilities of those skilled in the art.

The mouthpiece 5 comprises a short, generally tubular piece of rigid material. The lower part of this tubular piece provides a spout 11 with a cylindrical exterior wall and with two radially outward projecting lobes 12. The spout is adapted for axial registry and introduction into a suitable socket, which socket is also provided with recesses matched to the lobes 12 in order that the socket may secure the mouthpiece in a non-rotatable fashion. The top part of the mouthpiece 5 provides spigot 13 to which the lower end of the tube section is joined.

Spigot 13 exhibits a moderate wall thickness relative to the spigot inner diameter, e.g. 2 mm wall thickness against 11 cm inner diameter, in order that the spigot internal lumen 7 is virtually equal to that of the tube section providing the pouch. The spigot inside, at the top of the spigot 13 preferably exhibits a flaring 15 with the purpose of funneling any powder flowing downwards into the lumen in the mouthpiece.

The mouthpiece bottom annular surface 14 is oriented perpendicular to the axis of the mouthpiece, and it provides a seat for a septum 6 joined to the bottom surface 14 by annular weld 10.

The mouthpiece 5 is according to the preferred embodiment manufactured from polyethylene. Other rigid or substantially rigid plastic materials may be used in other embodiments. The septum preferably comprises polyethylene to a thickness around 0.1 mm at the section intended for piercing.

The cartridge 1 is manufactured in a process to which the basic components used comprise an open tube section, a mouthpiece, and a septum. The septum is welded to the mouthpiece at the lower end thereof, and the tube section is welded to the mouthpiece upper end by one end. This provides a generally cylindrical container with a closed bottom and with an upward opening. A predetermined quantity of powdered material is filled into this container. Subsequently the container interior is evacuated of air and the upper empty portion of the tube section allowed to collapse. The upper end portion of the tube section is sealed by a transverse linear weld 8.

A filling of powdered chemicals, suitable for use in preparing a photographic developer bath may comprise ingredients as follows: hydroquinone; sodium sulfite; borax; a strong base, such as sodium hydroxide; potassium bromide and one or more additives. Hydroquinone and sodium hydroxide are mutually reactive in solid state and should consequently not be in direct contact during transportation and storage prior to the preparation of the developer bath. However, by providing in the container a layer of sodium sulfite and borax as a separating layer between a layer of hydroquinone and a layer of sodium hydroxide, and by immobilizing the layers through evacuation of the container, these materials can be stored in the same package for long periods of time without suffering any significant degradation.

Suitable proportions of the ingredients may be as follows:

| | |
|---|---|
| Ethylene diamine tetraacetic acid | 20 g |
| Hydroquinone | 312 g |
| 1-phenyl-3-pyrazolidone | 8 g |
| Sodium sulfite | 1250 g |
| Potassium bromide | 75 g |
| Borax | 312 g |
| Sodium hydroxide | 168 g |
| Total | 2145 g |

Further details concerning fillings for the container may be derived from U.S. Pat. No. 5,314,069, the contents of which are incorporated hereinto by reference.

Due to the container interior being evacuated of air, the powdered content is immobilized and the cartridge appears as a solid block which is easy in handling. Automatic dispensing is carried out by installing the cartridge in a suitable fixture oriented as shown in FIG. 1, by cutting open the septum by a circular cut, adjacent the inner edge of the bottom annular surface. The circular cut is carried a full turn around except for a short section which is left uncut in order that the center portion of the septum stays adhered to one edge.

The flap thus formed bends downwards by its own weight and possibly by the load of the cartridge filling and clears a discharge opening generally similar in size and shape to the lumen 7 in the mouthpiece. As soon as the septum has been punctured, the vacuum inside the pouch is relieved; however the pouch retains its shape while the powdered filling starts flowing outwards. The tubular shape provides it with the capability of remaining standing with little likelihood of forming folds or wrinkles which might impair the outflow of the filling.

Once the cartridge has been emptied, the large opening permits washing or blowing of the pouch interior in order to clean out any filling residues.

Figure 3:
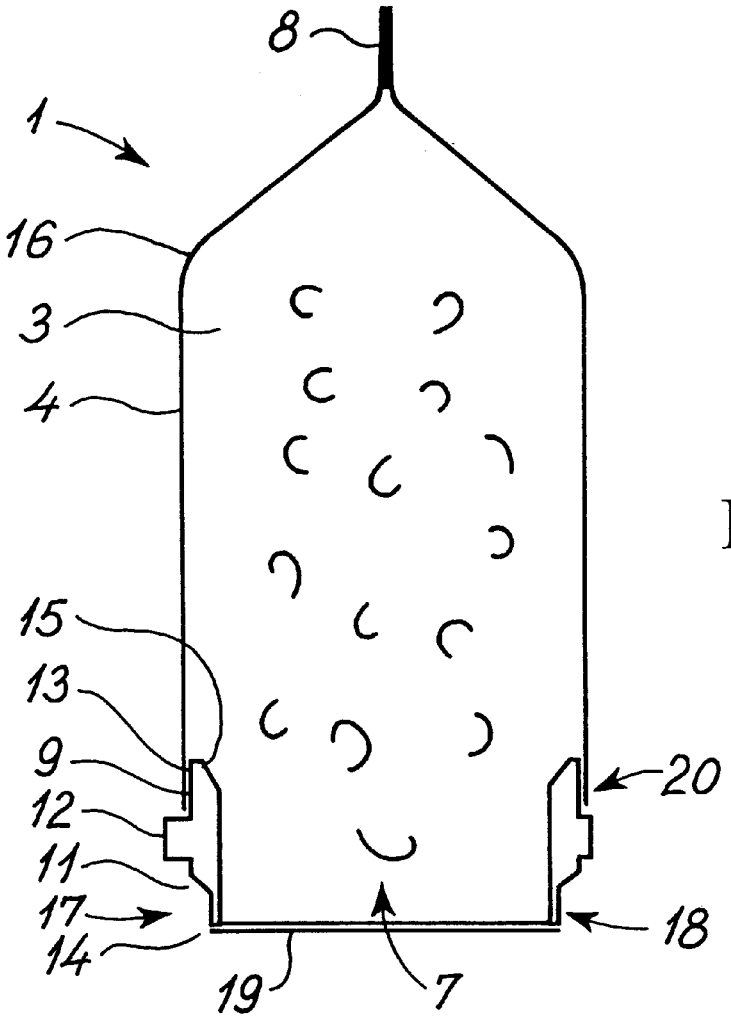
FIG. 3 shows a vertical axial section through a container according to the second embodiment of the invention.
Figure 4:
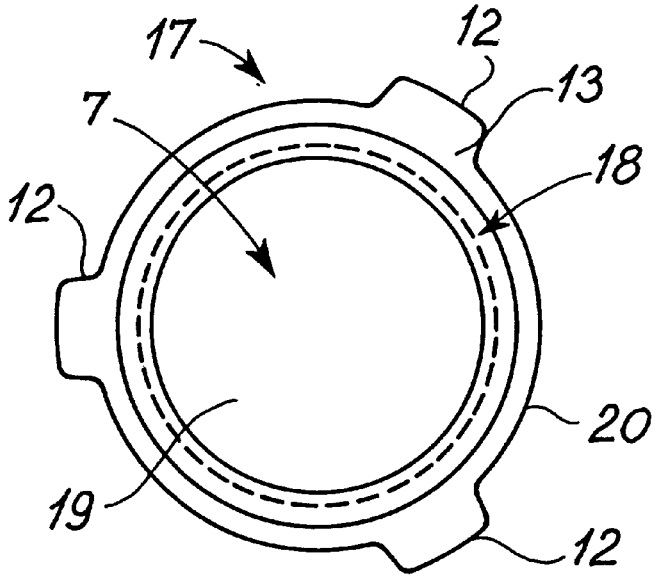
FIG. 4 shows a plan view of the component which forms part of the container according to the second embodiment of the invention.

Reference is now made to FIGS. 3 and 4 for a description of a container according to a second embodiment of the invention.

The container 16 according to the second embodiment basically only differs from the first embodiment container by the mouthpiece and by the septum. In the second embodiment, the mouthpiece 17 comprises a bottom disc 19 integral with a tubular piece 20. The tubular piece 20 differs from the mouthpiece 5 of the first embodiment by exhibiting a thin-walled sleeve section 18 of the spout. In the preferred embodiment, this sleeve section exhibits a wall thickness of 0.5 mm. This has the purpose of providing a seal means in the form of a peripheral section which may be cut by a knife, engaging the mouthpiece 17 from a radial direction. The mouthpiece 17 further comprises three radially projecting lobes for enhanced retention by a suitable mating socket.

As there is no need for cutting the disc 19, this part may be provided by a somewhat more sturdy component which provides a sole which is well suited for enduring such wear as may occur when standing the container on the disc and when handling the container. In the preferred embodiment, this component comprises a disc of polyethylene of a thickness of 1 mm. Thus the container 16 according to the second embodiment avoids having a very delicate piece on the bottom face which may be subjected to wear.

When cutting the sleeve section 18, the adjacent thick-walled section of the tubular piece 20 together with the adjacent disc 19 provides structural support in order to facilitate the cutting operation. The cutting operation is preferably carried out in a similar manner as is the case with the first embodiment, i.e. the cut is carried over one whole revolution except for a small stub which is left in order that the disc cut loose remains attached to the mouthpiece.

Unless otherwise indicated, all steps in manufacturing and filling of the container according to the second embodiment similar to the similar steps in manufacturing and filling of the container according to the first embodiment, therefore reference may be had to the above description.

Although specific embodiments have been described above it is emphasized that the invention may be exercised in several ways and that the explanation given above exclusively serves to clarify the invention and not to limit the scope of protection conferred, which is exclusively defined by the appended claims.

We claim:

1. A container for bulk matter, comprising a pouch of flexible material, provided by a section of a hose with substantially uniform circumference, a substantially rigid mouthpiece in sealing connection with said pouch by one end of said section of hose, said mouthpiece defining a lumen matched to said pouch and communicated with said pouch, said mouthpiece defining a base for standing said container and a substantially circular spout with an exterior guiding surface, a seal means adapted for sealing off said mouthpiece, and retention means associated with said mouthpiece and adapted for cooperation with engagement means of a socket so as to retain said mouthpiece in said socket in a non-rotatable fashion.

2. The container according to claim 1, wherein said mouthpiece lumen exhibits a circumference substantially equal to that of the hose.

3. The container according to claim 2, wherein said hose is sealed in the end opposite to the mouthpiece by a transverse weld.

4. The container according to claim 1, wherein said seal means comprises a seal membrane, structurally supported by said mouthpiece.

5. The container according to claim 1, wherein said seal means comprises a peripheral wall section of reduced thickness.

6. The container according to claim 1, wherein said mouthpiece comprises a sole means, adapted for standing said container.

7. The container according to claim 1, wherein said retention means comprises radially outward projecting lobes.

8. A cartridge comprising a container and a powdered filling, said container comprising a pouch of flexible material, provided by a section of a hose with substantially uniform circumference, a substantially rigid mouthpiece in sealing connection with said pouch by one end of said section of hose, and a seal means to seal off said mouthpiece, said mouthpiece defining a lumen matched to said pouch and communicated with said pouch, said mouthpiece defining a base for standing said container and a substantially circular spout with an exterior guiding surface, and said filling comprising at least three layers of solid particulate materials arranged inside of said container, a first one and a second one of said layers comprising respective mutually reactive materials and a third one of said layers, arranged intervening of said first and said second layer, comprising a material, which is inert relative to the materials of said first and said second layer, said container being evacuated of air so as to immobilize said particulate materials and sealed.

9. The cartridge according to claim 8, wherein said mouthpiece lumen exhibits a circumference substantially equal to that of the hose.

10. The cartridge according to claim 9, wherein said hose is sealed in the end opposite to the mouthpiece by a transverse weld.

11. The cartridge according to claim 8, wherein said seal means comprises a seal membrane, structurally supported by said mouthpiece.

12. The cartridge according to claim 8, wherein said seal means comprises a peripheral wall section of reduced thickness.

13. The cartridge according to claim 8, wherein said mouthpiece comprises a sole means, adapted for standing said cartridge.

14. The cartridge according to claim 8, wherein said container comprises a retention means associated with said spout for cooperating with said socket so as to retain said spout in said socket in a non-rotatable fashion.

15. The cartridge according to claim 14, wherein said retention means comprises radially outward projecting lobes.

* * * * *